United States Patent [19]

Lovin

[11] Patent Number: 4,630,828

[45] **Date of Patent: * Dec. 23, 1986**

[54] SAND TRAP PRACTICE DEVICE

[76] Inventor: Arthur Lovin, 2609 Petaluma Ave., Long Beach, Calif. 90815

[ * ] Notice: The portion of the term of this patent subsequent to Aug. 20, 2002 has been disclaimed.

[21] Appl. No.: 765,860

[22] Filed: Aug. 14, 1985

Related U.S. Application Data

[63] Continuation-in-part of Ser. No. 617,960, Jun. 7, 1984, Pat. No. 4,535,989.

[51] Int. Cl.[4] ..... A63B 69/36

[52] U.S. Cl. ..... 273/176 FB; 273/195 R; 273/176 B; 206/575; 206/315.1

[58] Field of Search ..... 273/195 R, 181 A, 176 FB, 273/176 B, 176 F, 176 FA, 32 R, 35 R, 35 B; 206/575, 315.1, 823, 408, 409, 410; 119/15

[56] References Cited

U.S. PATENT DOCUMENTS 3,540,734 11/1970 Temple ..... 273/181 A
4,535,989 8/1985 Lovin ..... 273/195 R

*Primary Examiner*—George J. Marlo

*Attorney, Agent, or Firm*—Klein & Szekeres

[57] ABSTRACT

Apparatus for the practice of sand trap golf shots comprises a receptacle formed from one or more pieces of foldable sheet material. In one embodiment, the sheet material is supported in the configuration of a receptacle by being placed inside of a tray. In another embodiment, the material is attached to a frame for support. One piece of material forming the receptacle has an integral extension which, when unfolded, extends outwardly from one or more sides of the receptacle to form an apron. The receptacle is filled with sand or a suitable substitute. A golfer can practice hitting balls out of the sand. The sand scattered by the golfer's swings falls on the apron, which can then be lifted over the receptacle to return the sand to the receptacle's interior. When the apparatus is not in use, the apron is simply folded up over the sand, thereby protecting the sand from the elements. A golf shot aiming device is advantageously included in the apparatus. The aiming device comprises a pair of perpendicular panels, and it can be partially embedded in the sand with one of the panels protruding to provide a guide or a target for aligning or aiming a golf shot.

14 Claims, 11 Drawing Figures

FIG. 3
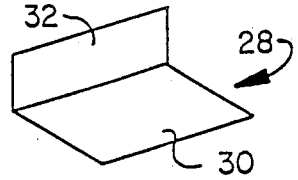
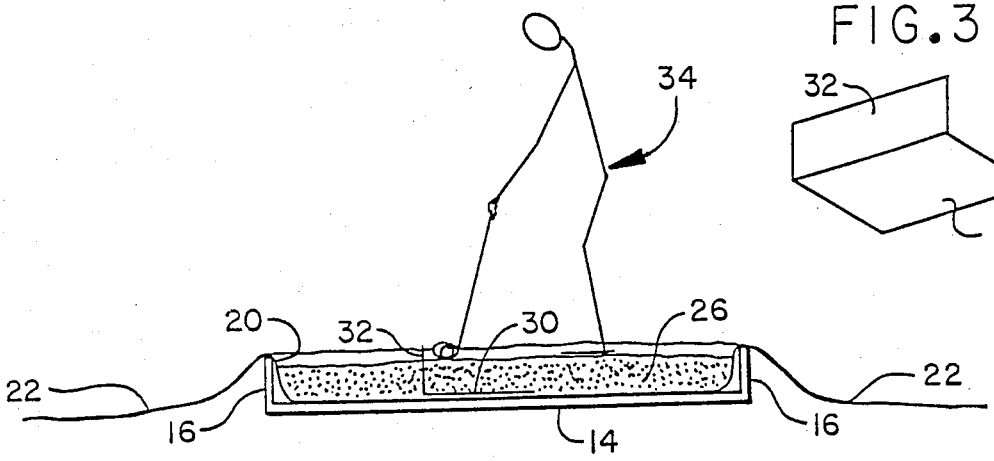
FIG. 4
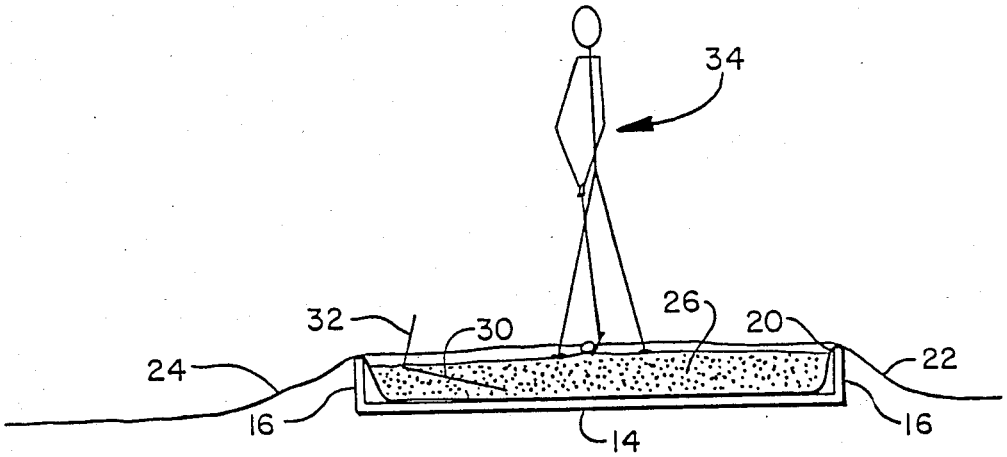
FIG. 5
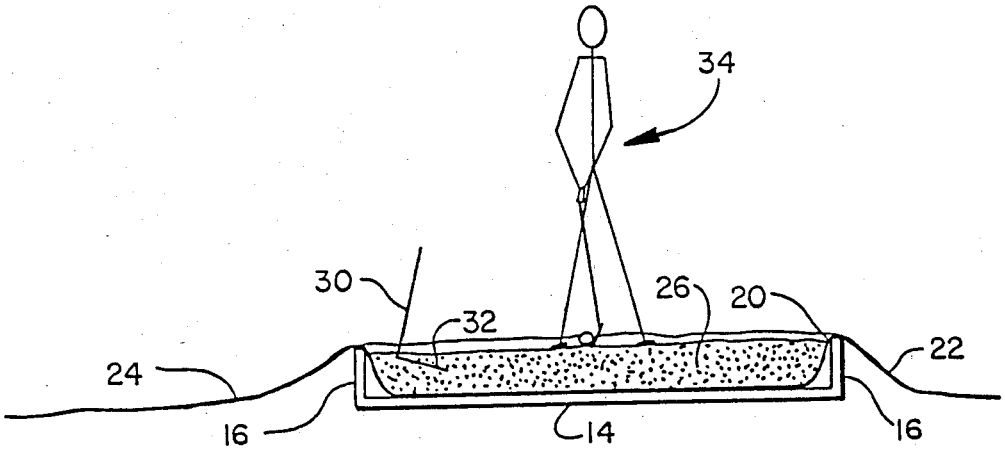
FIG. 6

SAND TRAP PRACTICE DEVICE

CROSS REFERENCE TO RELATED APPLICATION

This application is a Continuation-In-Part of co-pending application Ser. No. 617,960; filed June 7, 1984; now U.S. Pat. No. 4,535,989.

BACKGROUND OF THE INVENTION

This invention relates generally to the field of devices for use in practicing golf shots. More particularly, it relates to golf shot practice devices which provide portable or semi-portable golfing surfaces, and which allow the practice of sand trap or "bunker" shots.

Golf is a game in which much practice is required to achieve a satisfactory degree of proficiency. Many golfers, accordingly, seek to practice or perfect their games at every opportunity. Thus, a large number of devices have been developed to allow golfers to practice various aspects of their games while away from a golf course, and even in their homes.

One class of such golf practice devices is the type of device which provides a portable or semi-portable surface which simulates one or more of the different types of playing surfaces of an actual golf course. Examples of this class of device are disclosed in U.S. Pat. No. 3,735,988 to Palmer, et al., and U.S. Pat. No. 3,936,055 to Scott. The devices disclosed in these patents provide simulated putting green and fairway surfaces which can be moved about without undue difficulty. These devices, however, do not provide any means for simulating a sand trap or "bunker".

Thus, the golfer who desires to practice sand trap shots is left with little in the way of convenient practice devices. U.S. Pat. No. 3,025,059 to DiBuono discloses a device which allows one to practice sand trap shots. The DiBuono device, however, is a relatively massive apparatus designed for a permanent or semi-permanent installation, and thus cannot be used within the relatively confined spaces of the average home or residential yard.

Therefore, it would be highly advantageous to provide a golf shot practice device which allows the practice of sand trap shots within the golfer's home or yard. To this end, such a device should be portable or semi-portable, and it should also provide some means for minimizing the mess from scattered sand which results from these shots.

SUMMARY OF THE INVENTION

Broadly, the present invention comprises a receptacle formed from one or more pieces of foldable material, with means for supporting the piece or pieces of material in the configuration of a receptacle. The piece (or one of the pieces) includes a portion that extends, when unfolded, outwardly from one or more sides of the receptacle to form an apron along at least one side of the receptacle's outer perimeter. The receptacle formed by the piece or pieces of material is adapted to be filled with sand, or some other suitable particulate material, which can be used to simulate sand. Thus, a person can hit a golf ball out of the sand with a golf club, and the scattered sand resulting from the stroke of the club will land on the exterior apron. When practice is finished, the user can then simply fold the apron up over the receptacle to return the sand captured thereon neatly back into the receptacle.

In a first preferred embodiment, the receptacle is formed from a unitary sheet of foldable material contained in, and supported by, a flat-bottomed tray having substantially vertical sides, and a substantially uniform depth. The sides of the tray define a perimeter enclosing an area large enough for a person to stand within it and swing a golf club. The sheet, when folded, is fully containable within the tray. When unfolded, the sheet has an exterior portion which extends over the sides of the tray and outwardly around the receptacle's perimeter. The portion of the sheet inside the tray forms the receptacle, having sides and a bottom supported by the tray. This receptacle can be filled with sand or sand-like material. Preferably, the sheet is configured so that, when unfolded, the exterior portion or apron extends farther outwardly from one side of the receptacle than it does from the other sides. The golfer swings the club toward the farther-extended side of the apron, which captures the bulk of the sand scattered by the golfer's swing of the club.

In a second preferred embodiment, the receptacle is formed by one or more sheets of foldable material that are supported in the configuration of a receptacle by a frame of detachably interconnected tubular members resting on a plurality of short, vertical legs. The frame, like the tray of the first embodiment, defines a perimeter enclosing an area large enough for a person to stand and swing a golf club therein. In a specific example of the second embodiment, a first piece of foldable material is attached around the frame to form the sides of the receptacle, and a second piece of such material is attached to the bottom edge of the first piece to form a substantially planar bottom for the receptacle, the bottom being substantially coextensive with the area enclosed within the perimeter defined by the frame. The first piece of material includes an integral portion that extends over one side of the frame and unfolds to form a flat apron of material extending outwardly from that side of the frame. As in the first preferred embodiment, the apron is oriented so that the club is swung by th toward the apron, allowing most of the scattered sand to land on the apron.

The invention advantageously includes a golf shot aiming or guiding device which can be partially embedded in the sand, with a guiding or aiming surface extending upwardly through the sand's surface. The guiding or aiming surface can be oriented to act either as a guide for aligning the golfer's stance and club, or as a target over which a user would aim in shooting the ball out of the sand. In its preferred form, the aiming device comprises a pair of perpendicular planar members, with one of the members being substantially longer than the other, so as to be approximately "L"-shaped in cross-section. If the device is embedded with the shorter member protruding through the sand and aligned parallel to the desired direction of the golfer's swing, it acts as a guiding surface. If the device is oriented with either the shorter or longer member protruding through the sand transversely to the direction of the swing, it provides an aiming surface over which the golfer must direct the shot.

The entire practice apparatus, including the receptacle and the aiming device, can be made in dimensions which allow the apparatus to be at least semi-portable, even when filled with sand.

Thus, as will be more fully appreciated from the detailed description which follows, the present invention allows a golfer to practice sand trap shots conveniently while away from the golf course, using a device which can be transported from place to place. Moreover, the device can even be used indoors (with practice golf balls of suitable plastic or foam material) without a mess resulting from scattered sand. Furthermore, the invention, including the aiming device, provides the golfer with an effective aid in the practice and perfection of sand trap shots.

BRIEF DESCRIPTION OF THE DRAWINGS

FIG. 3 is a perspective view of a preferred embodiment of the aiming device used in the present invention;

FIG. 4 is a cross-sectional view taken along line 4—4 of FIG. 1, and showing the aiming device of FIG. 3 used as a guide;

FIG. 5 is a cross-sectional view along line 5—5 of FIG. 1, showing the aiming device of FIG. 3 used as a low target over which the golfer would aim to shoot the ball out of the trap;

FIG. 6 is a cross-sectional view, similar to FIG. 5, showing the aiming device oriented as a high target;

DETAILED DESCRITION OF THE INVENTION

A. The First Preferred Embodiment

Figure 2:
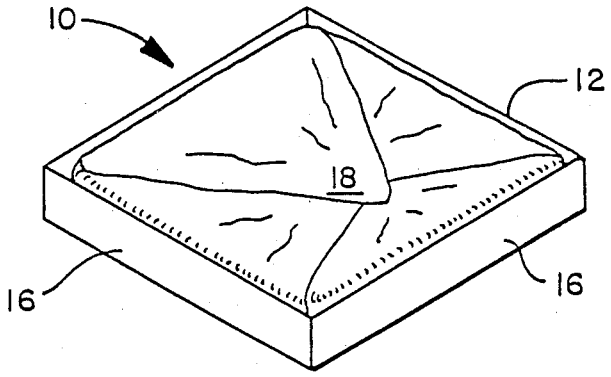
FIG. 2 is a perspective view of the first preferred embodiment, illustrating its storage mode.
Figure 1:
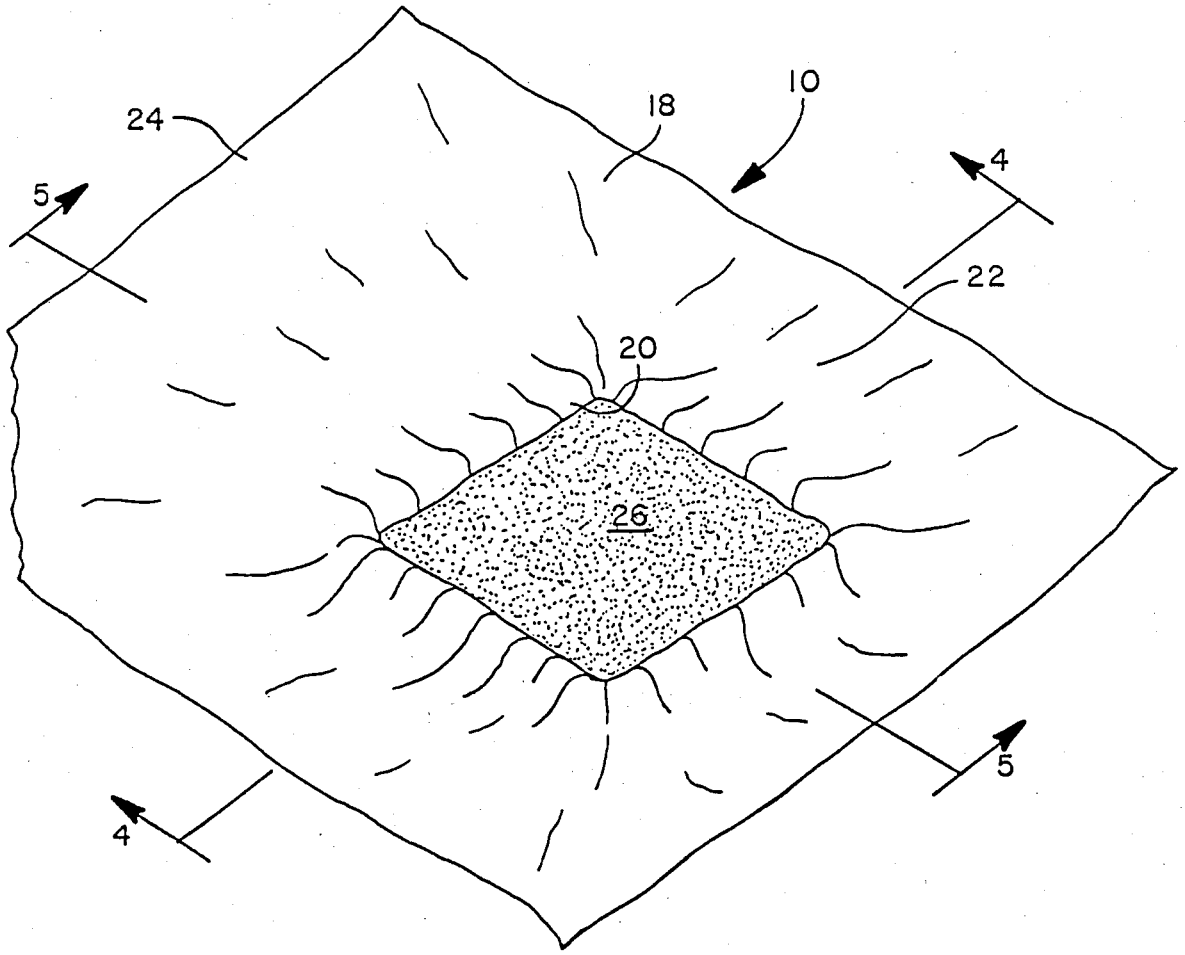
FIG. 1 is a perspective view of a first preferred embodiment of the present invention, showing the invention in its playing mode.

Referring first to FIGS. 1 and 2, a sand trap practice device 10, in accordance with a first preferred embodiment of the present invention, is shown. In FIG. 1, the device 10 is shown in its playing mode; in FIG. 2, in its storage mode. As best shown in FIG. 2, the device includes a tray 12 having a flat, planar bottom 14 (FIGS. 4, 5, and 6) and vertical side walls 16. The preferred shape for the tray 10 is square or rectangular, although other shapes can be used as well. In the tray's rectangular embodiment, its horizontal dimensions are advantageously from about 2 feet by 3 feet to about 2.5 feet to 3.5 feet. The tray can be made larger, if desired, but at the expense of portability. The horizontal dimensions should be large enough so that the side walls 16 of the tray define a perimeter enclosing an area large enough to allow a person to stand within the perimeter and swing a golf club therein. The depth of the tray should be uniform, and preferably in the range of about 3 to 4 inches. A rigid plastic material (such as polyvinyl chloride, for example) is a preferred material for the tray. The material of the tray should be thick enough and strong enough to support the weight of the material contained in the tray, as described below, as well as to withstand the stresses of an adult human standing in the tray's interior.

Contained within the tray 12 is a sheet 18 of a strong, pliable, foldable material. While the sheet 18 can be made of a strong cloth, such as canvas, a suitable plastic is preferred, to minimize weight, and for ease of cleaning and maintenance. For a rectangular tray with dimensions in the range given above, the sheet 18 should be rectangular, with preferred dimensions in the range of about 5 to 6 feet by 6 to 7 feet.

In actuality, the sheet 18 is fully contained within the tray 12 only when the practice device 10 is in its storage mode, as will be described below, with the sheet 18 folded up, as shown in FIG. 2. When the device is in its playing mode (FIG. 1), the sheet 18 has an interior portion 20 in the interior of the tray 12, which is supported by the tray in the configuration of a receptacle having substantially vertical sides supported by the side walls 16 of the tray, and a bottom coextensive with the bottom of the tray. The sheet 18 has an integral exterior portion which extends over the sides 16 of the tray to form an apron 22 around the tray's perimeter. As shown in FIG. 1, the sheet 18 is preferably arranged so that the apron 22 has one side 24 which extends farther out from the tray than do the other sides of the apron, the advantage of this arrangement being described below. The sheet 18 may, optionally, be removably attached to the inside of the tray by suitable attachment means (not shown).

As best seen in FIG. 1, the receptacle, formed by the interior portion 20 of the sheet 18, is adapted to be filled with a quantity of sand 26, preferably as a layer spread evenly throughout the receptacle. Although sand is preferred, other particulate materials which closely simulate sand may be found to be suitable.

In the playing mode of the invention (FIG. 1), a golfer stands in the receptacle and hits golf balls out of the sand layer. In using the first preferred embodiment shown in FIG. 1, with the apron 22 having the one extended side 24, the golfer stands so as to swing toward the extended side 24. Since most of the sand scattered as a result of the shot travels in the same direction as the golfer's swing, the larger apron area provided by the extended side 24 is available to catch the bulk of the scattered sand. Sand scattered in other directions will land on the other areas of the apron 22.

When the golfer is finished practicing, the apron 22 is lifted over the tray 12 so that the sand which has fallen on the apron 22 is returned to the receptacle. The practice device may then be returned to its playing mode, or the device may be placed in its storage mode by neatly folding the sheet 18 completely to enclose the sand within the tray 12, as shown in FIG. 2. With the device in its storage mode, it may be transported from place to place without spilling the sand. The use of a sheet made of a waterproof material, such as a suitable plastic, will protect the sand from the elements, thereby allowing the practice device to be stored outdoors.

B. The Aiming Device

Turning now to FIG. 3, an aiming or guiding device 28 advantageously used with the present invention is shown. The aiming device 28 preferably comprises a pair of planar members 30,32 joined at a right angle so as to present an "L" shape in cross-section. In this configuration, one planar member (e.g. member 30) is substantially longer than the other member (e.g. member 32), as measured from their juncture. As a specific example of an aiming device 28, the member 30 is approximately 8 inches long; the member 32 is approximately 4 inches long; and both members have a width of approximately 12 inches. The longer member is thus, preferably, at least twice as long as the shorter member. The preferred material for the aiming device 28 is a rigid plastic, such as polyvinyl chloride, although a metal (e.g. aluminum) can also be used.

The use of the aiming device 28 is illustrated in FIGS. 4, 5, and 6. In FIG. 4, the aiming device is partially embedded in the sand layer 26 so that a portion of the shorter planar member 32 protrudes above the surface of the sand. The aiming device is oriented to be substantially parallel with the direction of the swing of a golfer 34, so that the aiming device 28 acts as a guide for aligning the golfer's swing. The golfer would thus practice taking straight swings, using the shorter member 32 as an alignment aid.

In FIGS. 5 and 6, the use of the aiming device 28 as a target is illustrated. In FIG. 5, the aiming device 28 is partially embedded in the sand 26 so that most of its shorter member 32 is protruding from the sand. The aiming device is oriented so that the member 32 extends substantially perpendicular to the golfer's direction of swing, with the member 32 being angled slightly toward the golfer. In FIG. 6, the placement and orientation of the aiming device is similar, except that it is the longer member 30 which protrudes through the sand's surface. In either case, the protruding member of the aiming device 28 presents a target or obstacle over which the golfer must hit the ball.

If the length of the shorter member 32 of the aiming device 28 is no greater than the depth of the tray 12, the aiming device may be placed flat on the surface of the sand 26 with the shorter member extending downwardly, so that the aiming device can be enclosed within the sheet 18 when the practice device is in its storage mode (FIG. 1).

C. The Second Preferred Embodiment

FIGS. 7 through 11 illustrate a second preferred embodiment of the invention. In this embodiment, the sand-containing receptacle is formed by one or more pieces of foldable sheet material supported by a tubular frame. One piece of foldable material forming the receptacle has an exterior portion that unfolds to form an apron extending from one side of the receptacle.

Specifically, the second preferred embodiment includes a receptacle 40 of foldable sheet material adapted to contain a layer of sand 42 or a suitable substitute. The receptacle 40 is supported by a frame 44 (FIG. 9) formed from a plurality of interconnecting tubular members 46. The tubular members 46 interconnect, in a manner to be described below, to define the perimeter of the receptacle and the upper edges of its sides. In the illustrated embodiment, the frame 44 is substantially square, with rounded corners. As with the first preferred embodiment, a variety of other configurations (e.g. circular, elliptical, rectangular) can be employed. The horizontal dimensions of the frame 44 are, preferably, similar to those of the tray 12 of the first preferred embodiment. Thus, the frame defines a perimeter enclosing an area large enough to allow a person to stand within the perimeter and swing a golf club therein.

Figure 9:
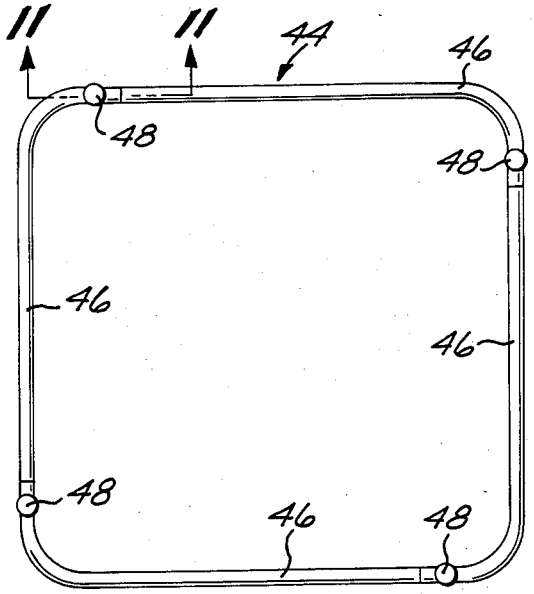
FIG. 9 is a bottom plan view of the tubular frame of the second preferred embodiment.

The frame rests on, and is elevated from a supporting surface 62 (i.e., the ground or a floor) by a plurality of short vertical legs 48. In the illustrated embodiment, there are four such legs 48, one on each of the four tubular members 46 that form the frame 44. The legs 48 are located on the tubular members 46 so that when the tubular members 46 are interconnected to form the frame 44, the legs 48 are adjacent the rounded corners thereof, as best shown in FIG. 9. The height of the legs 48 is small relative to the horizontal dimensions of the frame 44, so that the overall dimensions of the frame and leg structure are similar to those of the tray 14 of the first embodiment described above.

Figure 8:
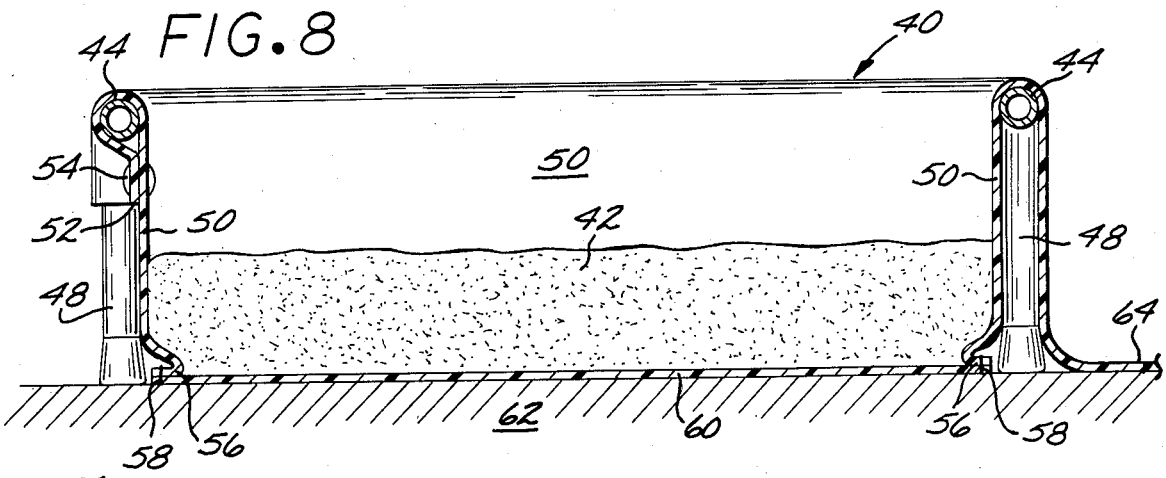
FIG. 8 is a cross-sectional view taken along line 8—8 of FIG. 7.

The sides and bottom of the receptacle 40 are formed from foldable sheet material. A first piece 50 of such material is fastened onto the frame 44 to form the sides of the receptacle. This first or side-forming piece 50 has an upper edge 52 which is wrapped around the frame 44, on three sides thereof. As best shown in FIG. 8, this upper edge 52 is then removably fastened to the adjacent section of the side-forming piece 50 by means such as snap fasteners 54. The side-forming piece 50 has a lower edge 56 which is joined (as by stitching 58) to the peripheral edge of a second sheet 60 of similar material which forms a planar bottom for the receptacle. The area of the receptacle bottom formed by the second piece 60 is approximately coextensive with the area enclosed within the perimeter defined by the frame 44. Preferably, the vertical dimension of the side-forming piece 50 is slightly greater than the height of the legs 48, so that the juncture between the lower edge 56 of the side-forming piece 50 and the peripheral edge of the second or bottom-forming piece 60 is assured of resting flat on the supporting surface 62. In this fashion, the entire bottom-forming piece 60, including the lower edge 56 of the side-forming piece 50, rests on the surface 62, allowing the weight of the sand 42 to be supported by the surface 62, rather than by the legs 48. It should be noted that the side-forming piece 50 and the bottom-forming piece 60 may, in fact, be formed as a unitary element, rather than in two separate pieces, as shown.

One side of the side-forming piece 50 extends into an integral, foldable sheet or apron 64. The apron 64, when unfolded, extends over one side of the frame 44, and then outwardly from that side of the receptacle perimeter defined by that side of the frame, lying flat on the surface 62 in a substantially rectangular configuration, as shown in FIG. 7.

Figure 7:
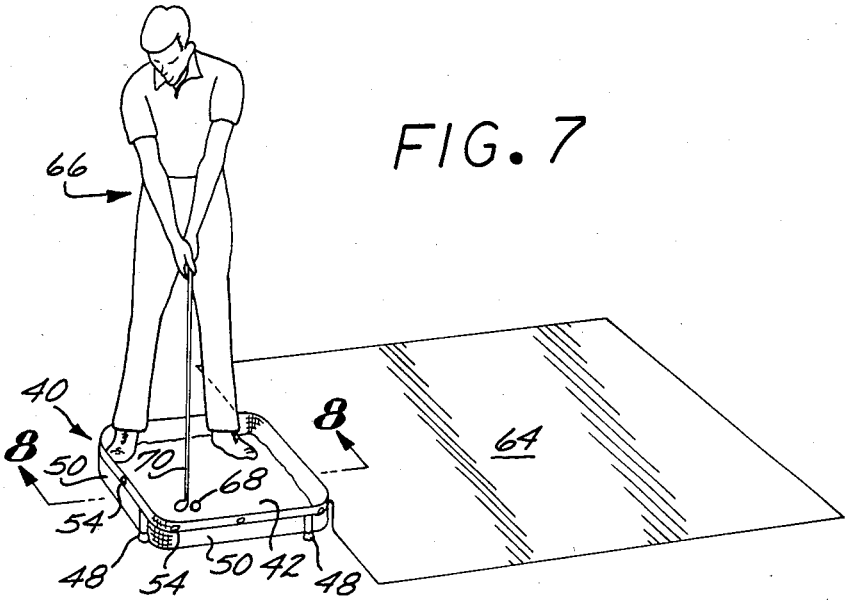
FIG. 7 is a perspective view of a second preferred embodiment of the invention, illustrating it in use by a golfer.

Use of this embodiment of the invention is shown in FIG. 7. A golfer 66 stands in the receptacle 40, with a golf ball 68 placed on the layer of sand 42. The golfer swings a golf club 70 at the ball 68, attempting to hit the latter out of the receptacle 40. The stroke of the club 70 causes sand to scatter from the receptacle. This scattered sand (or at least the bulk of it) lands on the apron 64. When the golfer is finished using the device, the apron 64 is simply folded so as to retain the sand captured thereon, and this captured sand is then returned to the receptacle 40.

Although the apron 64 is shown extending from only one side of the receptacle, it may easily be modified to extend outwardly from as many as three sides, leaving one side of the side-forming piece 50 for attachment to the frame 44.

Figure 10:
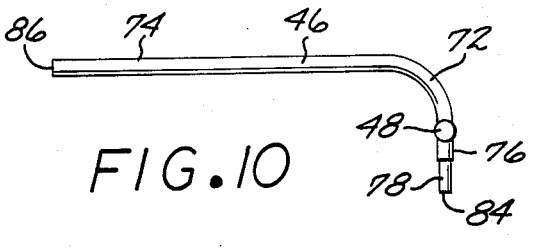
FIG. 10 is a plan view of one of the tubular elements forming the frame shown in FIG. 9.
Figure 11:
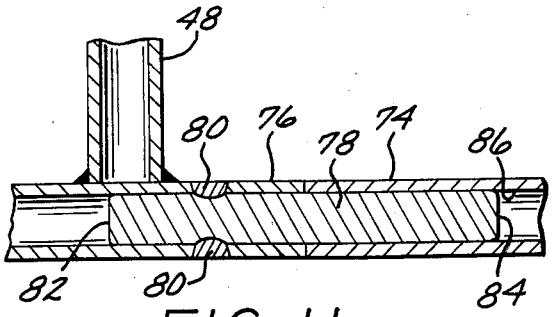
FIG. 11 is a detailed cross-sectional view of a portion of the frame of FIG. 9 taken along line 11—11 of FIG. 9, showing how the tubular elements of the frame fit together.

A unique feature of this second embodiment of the invention is illustrated in FIGS. 9, 10, and 11. As previously mentioned, the frame 44 is comprised of a plurality of interlocking tubular members 46. In the specific embodiment shown, the frame 44 is in the configuration of a square with rounded corners. This configuration is created by using four identical tubular members 46, each having the configuration shown in FIG. 10. Specifically, each tubular member 46 comprises a length of hollow, tubular material (e.g., a lightweight metal, such as aluminum) having an arcuate bend 72 near one end. The bend 72 thus provides the member 46 with a first, relatively long straight segment 74, and a second, relatively short straight segment 76, at substantially a right angle to each other. A short rod 78 is fastened into the open end of either one of the segments, by means such as plug welds 80 (FIG. 11). In the specific embodiment shown, the rods 78 are fastened into the ends of the short segments 76 of the tubular members 46; the rods can, however, all be fastened into the ends of the long segments 74. It is only important that the rods be fastened into the ends of the same segments in all of the tubular members 46 forming a frame 44, so that all of the tubular members in a frame are identical.

As best shown in FIG. 11, the rods 78 provide means for detachably interconnecting the tubular members 46. Specifically, each rod has a first end 82 which is fixed into one end of a first tubular element 46 (as by the plug welds 80), and a second end 84 that protrudes from the end of that tubular element. The protruding end 84 of the rod 78 thus forms a male connecting element that can be removably inserted into a female connecting element provided by a hollow open end 86 of an adjoining second tubular element 46. In this fashion, the four tubular elements 46 can be detachably interconnected to one another to form the closed frame 44.

Although the male connecting elements have been described as solid rods 78, they can also be in the form of short lengths of hollow tubular material. In either case, the outside diameter of the male connecting element must be slightly less than the inside diameter of the tubular elements 46, to assure a firm, but detachable, engagement therebetween.

The construction described above allows the invention to be easily assembled and disassembled for transportation. Thus, when the receptacle is emptied of sand, the side-forming piece of material 50 is simply unfastened from the frame 44 and folded up, along with the apron 64 and the bottom-forming piece 60. The four tubular elements 46 are then detached from one another. Thus disassembled, the device can be easily transported and reassembled at a new location.

It will be appreciated that the aiming device 28 described above in connection with the first preferred embodiment can be used as well with the second preferred embodiment.

There has thus been described a golf shot practice device which allows a golfer to practice sand trap shots conveniently while at home or otherwise away from the golf course. The device is conveniently stored and transported when not in use, and, when used, it minimizes the mess created by sand scattered by the golfer's swing. When the aiming device is used, the golfer is further aided in the development of a correct swing for successful play from a sand trap.

While preferred embodiments of the invention have been shown and described, it will be appreciated that variations from the precise structure of these embodiments will suggest themselves to those skilled in the pertinent arts. Therefore, the preferred embodiments should be considered exemplary forms of the present invention, the scope of which is defined in the claims which follow.

What is claimed is:

1. Apparatus for the practice of golf shots, comprising:

support means defining a perimeter enclosing an area large enough to allow a person to stand within said perimeter and swing a golf club therein, said support means including a frame having a plurality of short, vertical legs for resting said frame on a supporting surface and elevating said frame from said surface;

a piece of foldable sheet material supported by said support means to form a receptacle having substantially vertical sides approximately at said perimeter and a substantially planar bottom substantially coextensive with the area enclosed by said perimeter, the height of said sides being small relative to the horizontal dimensions of the enclosed area, said piece of foldable sheet material having an integral extension portion that, when unfolded, extends over at least one side of said support means to form an apron extending outwardly from the perimeter of said support means; and a layer of particulate material contained in said receptacle;

said apron extending outwardly from the perimeter of said support means along at least one side of said receptacle by a distance sufficient to catch a substantial amount of the particulate material which is scattered from said receptacle as a result of a person swinging a golf club into said particulate material.

2. The apparatus of claim 1, wherein said piece of foldable sheet material comprises:

a side-forming portion defining the sides of said receptacle and having an upper edge and a lower edge, said upper edge being attached to said frame; and a bottom-forming portion defining the bottom of said receptacle and having a peripheral edge joined to the lower edge of said side-forming portion;

said extension portion being unitary with said side-forming portion along at least one side of said frame.

3. The apparatus of claim 2, wherein the vertical dimension of said side-forming portion is greater than the height of said legs, so that the juncture between the lower edge of said side-forming portion and the peripheral edge of said bottom-forming portion lies substantially flat on said supporting surface.

4. The apparatus of claim 2, wherein said side-forming portion is removably attachable to said frame.

5. The apparatus of claim 1, wherein said frame comprises a plurality of tubular members which are detachably interconnected to define said perimeter.

6. The apparatus of claim 5, wherein each of said tubular members comprises:

first and second substantially straight segments joined at a substantially right angle to each other by an arcuate bend, said first segment having a first end and said second segment having a second end; and means for detachably connecting the first end of one of said tubular members to the second end of an adjoining tubular member.

7. The apparatus of claim 6, wherein said means for detachably connecting comprises:

a hollow portion in said first end of each of said tubular members, said hollow portion defining a female connection element; and a male connection element extending from said second end of each of said tubular members, said male connection element being removably insertable into an adjoining female connection element.

8. Apparatus for the practice of golf shots, comprising:

a frame defining a perimeter enclosing an area large enought to allow a person to stand within said perimeter and swing a golf club therein;

a plurality of legs attached to said frame for resting said frame on a supporting surface and elevating said frame from said surface;

a piece of foldable sheet material attached to said frame so as to form a receptacle having substantially vertical sides and a substantially planar bottom substantially coextensive with the area enclosed by said perimeter, the height of said sides being small relative to the horizontal dimensions of the enclosed area, said piece of foldable sheet material having an integral extension portion that, when unfolded, extends over at least one side of said frame to form an apron extending outwardly from the perimeter defined by said frame; and a layer of particulate material contained in said receptacle;

said apron extending outwardly from the perimeter defined by said frame along at least one side of said receptacle by a distance sufficient to catch a substantial amount of the particulate material which is scattered from said receptacle as a result of a person swinging a golf club into said particulate material.

9. The apparatus of claim 8, wherein said piece of foldable sheet material comprises:

a side-forming portion defining the sides of said receptacle and having an upper edge and a lower edge, said upper edge being attached to said frame; and a bottom-forming portion attached to the lower edge of said side-forming portion and defining the bottom of said receptacle;

said extension portion being unitary with said side-forming portion along at least one side of said frame.

10. The apparatus of claim 9, wherein the vertical dimension of said side-forming portion is sufficiently greater than the height of said legs to allow the lower edge of said side-forming portion to lie substantially flat on said supporting surface.

11. The apparatus of claim 9, wherein said side-forming portion is removably attachable to said frame.

12. The apparatus of claim 8, wherein said frame comprises a plurality of tubular members which are detachably interconnected to define said perimeter.

13. The apparatus of claim 12, wherein each of said tubular members comprises:

first and second segments joined by an arcuate bend, said first segment having a first end and said second segment having a second end; and connection means on said first and second ends for detachably connecting the first end of one of said tubular members to the second end of an adjoining tubular member.

14. The apparatus of claim 13, wherein said connection means comprises:

a female connection element in said first end of each of said tubular members; and a male connection element at said second end of each of said tubular members, said male connection element being removably insertable into an adjoining female connection element.

* * * * *